US009655466B1

(12) United States Patent
Bernstein et al.

(10) Patent No.: US 9,655,466 B1
(45) Date of Patent: May 23, 2017

(54) HANGER AND HOOK ATTACHMENT FOR FOLDING HOOK

(71) Applicant: SJBEE LLC, Hewlett, NY (US)

(72) Inventors: Steven J. Bernstein, Hewlett, NY (US); Leslie S. Blitz, New Hyde Park, NY (US)

(73) Assignee: SJBEE LLC, Hewlett, NY (US)

( * ) Notice: Subject to any disclaimer, the term of this patent is extended or adjusted under 35 U.S.C. 154(b) by 0 days.

(21) Appl. No.: 15/182,681

(22) Filed: Jun. 15, 2016

Related U.S. Application Data

(60) Provisional application No. 62/309,740, filed on Mar. 17, 2016.

(51) Int. Cl.
*A41D 27/22* (2006.01)
*A47G 25/14* (2006.01)
*A47G 25/32* (2006.01)

(52) U.S. Cl.
CPC ..... *A47G 25/1407* (2013.01); *A47G 25/1428* (2013.01); *A47G 25/32* (2013.01)

(58) Field of Classification Search
CPC ..... A47G 25/32; A47G 25/1407; A47G 25/1414; A47G 25/1428; A47G 25/40
USPC ..... 223/85, 88, 92, DIG. 4
See application file for complete search history.

(56) References Cited

U.S. PATENT DOCUMENTS

| | | | | |
|---|---|---|---|---|
| 3,790,046 | A * | 2/1974 | Rooney | A47G 25/50 223/92 |
| 4,168,791 | A * | 9/1979 | Clark, Jr. | A47G 25/50 223/94 |
| 5,074,445 | A * | 12/1991 | Chen | A47G 25/32 211/116 |
| 5,085,357 | A * | 2/1992 | Chen | A47G 25/4038 223/85 |
| 6,000,587 | A * | 12/1999 | Sackett | A47G 25/32 223/85 |
| 7,380,359 | B2 * | 6/2008 | Mainetti | A47G 25/1435 223/85 |
| 7,837,074 | B2 * | 11/2010 | Rude | A47G 25/32 223/85 |
| 8,113,393 | B2 * | 2/2012 | Ho | A47G 25/32 223/85 |
| 9,113,736 | B1 * | 8/2015 | Antler | A47G 25/32 |
| 2016/0088964 | A1 * | 3/2016 | Hansen | A47G 25/32 223/85 |
| 2016/0088965 | A1 * | 3/2016 | Hansen | A47G 25/32 223/85 |

* cited by examiner

*Primary Examiner* — Nathan Durham
(74) *Attorney, Agent, or Firm* — Levisohn Berger LLP

(57) ABSTRACT

A hanger with a foldable hook enabling the hanger to have the hook in a folded shipped position to reduce its footprint for reduction of cost of transportation and a rotatable cylindrical member to which the hook is attached, allowing the hook to be rotated from a folded to an upright hanging position.

4 Claims, 8 Drawing Sheets

HANGER AND HOOK ATTACHMENT FOR FOLDING HOOK

BACKGROUND OF THE INVENTION

Garment hangers have been around for hundreds of years. Modern day retail use garment hangers have many packaging and shipping requirements and specifications intended to increase efficiency in the supplier to retailer pipeline by minimizing order to sales floor or ecommerce shipment time.

Many ready to wear apparel garments are manufactured all over the world and then shipped to United States (or other countries) pre-hung as a "garment on hanger" from the originating garment manufacturing location. In order to save time and expense at the retail level the garment is placed on the hanger at the point of garment manufacturing and placed into a shipping box or container. Upon delivery to the retailer location, the retailer has to remove the "garment on hanger" from the box or container and hang it appropriately in a distribution center for ecommerce shipment or other shipment to an individual store.

Present day Omni Channel process dictates if the garment will be shipped directly to the sales floor or be shipped in ecommerce packaging. Since the retailer or the garment manufacturer does not always know which apparel item will go to the greater need, either brick and mortar store or ecommerce. Therefore, the need for a garment hanger that can be used in both channels without being changed is desired.

This invention relates to providing an individual hanger to be able to be used both at retail level and ecommerce shipments with the hanger having a folding hook.

Today's dimensional packaging shipping costs have made it desirable to have smaller shipping boxes saving costs based on the dimensions of the box.

An object of this invention is provide an improved hanger having a collapsible hook movable from vertical to horizontal positions.

Another object of this invention is to provide such a movable hook that is easy to assemble, secure in operation and provides stability for the movable hook structure of this invention.

Another object of this invention is to provide such a collapsible hook hanger which is easy to manufacture, susceptible to widespread use meets industry standards and economical to both manufacture and use.

Yet another object of this invention is to maintain the hook in either its horizontal or vertical positions as desired.

Other objects, advantages and features of this invention will become more apparent from the following description.

SUMMARY OF THE INVENTION

In accordance with the principles of this invention, a hook has a hook attachment into which the hook is placed. The hook attachment is rotatable within the hanger body within a circular space having a closed wall on one side with an open wall on the other. The hook attachment includes a self-locating interconnect allowing the hook attachment mechanism to fit within a recess in an easy and efficient manner and prevent access to the hook attachment from the rear side thereof. This prevention of such access further ensures stability of the hook attachment of this invention.

A sizer tab is formed with suitable recesses and slots enabling the sizer tab to fit onto and connect with the hook attachment and hanger body to provide size identity for clothing carried thereon.

DETAILED DESCRIPTION OF DRAWINGS

Figure 1A:
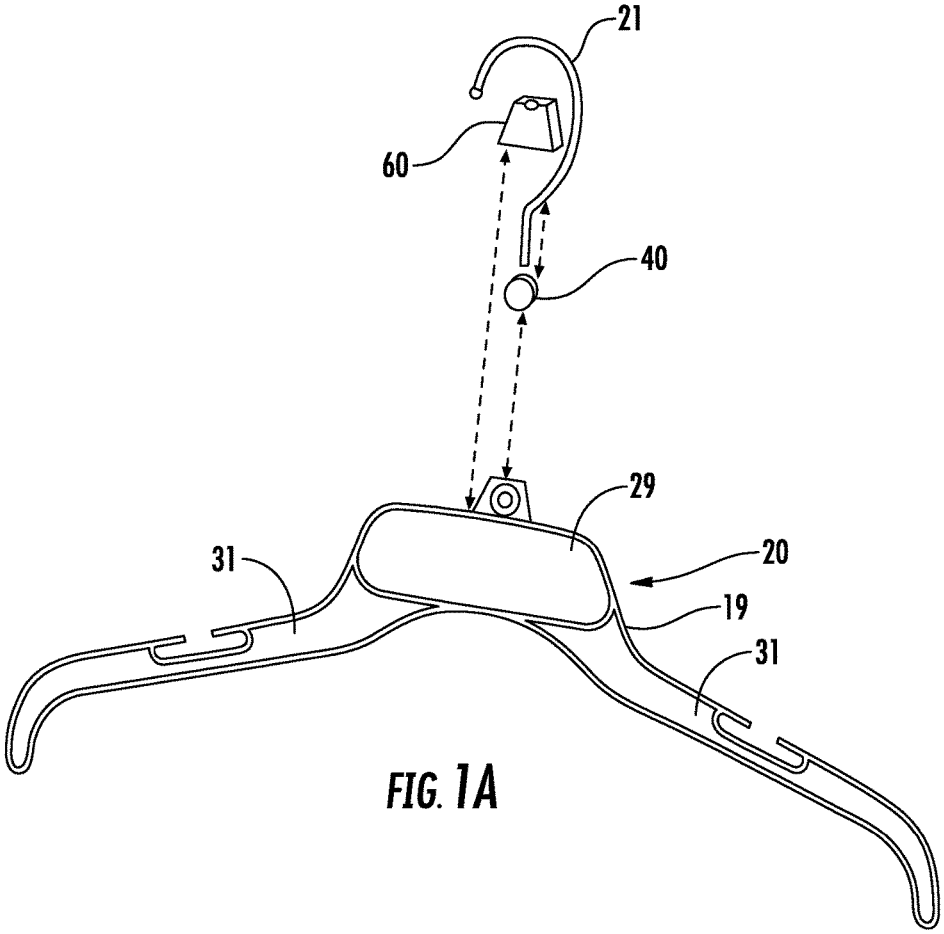
FIG. 1A is an exploded perspective view of the hanger assembly and the hook of the hanger in vertical position.

Referring to FIGS. 1A-1E, there are five images of hangers shown in various positions illustrating hanger body 19 with hook 21, as well as an exploded perspective view of locking the hook in a vertical position. Hanger body 19 preferably has a central head 29 and arms 31 and may be formed of an I beam construction. The hanger is shown with an attached hook 21 in the upright vertical position. However this design is not limited to I beam construction or limited to only top hanger designs. In another embodiment, hanger 20 could include a coordinate loop (not shown here) for receiving a second hanger or be of an entirely different silhouette or type of garment hanger.

Figure 1B:
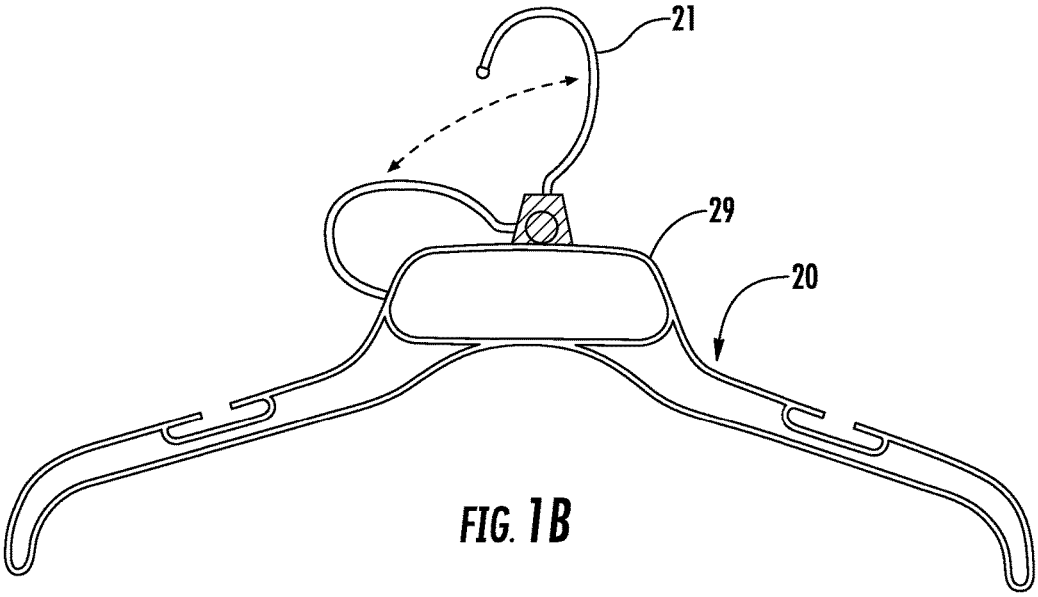
FIG. 1B is a front plan view of the hanger of this invention with the hook in horizontal and vertical positions.
Figure 1C:
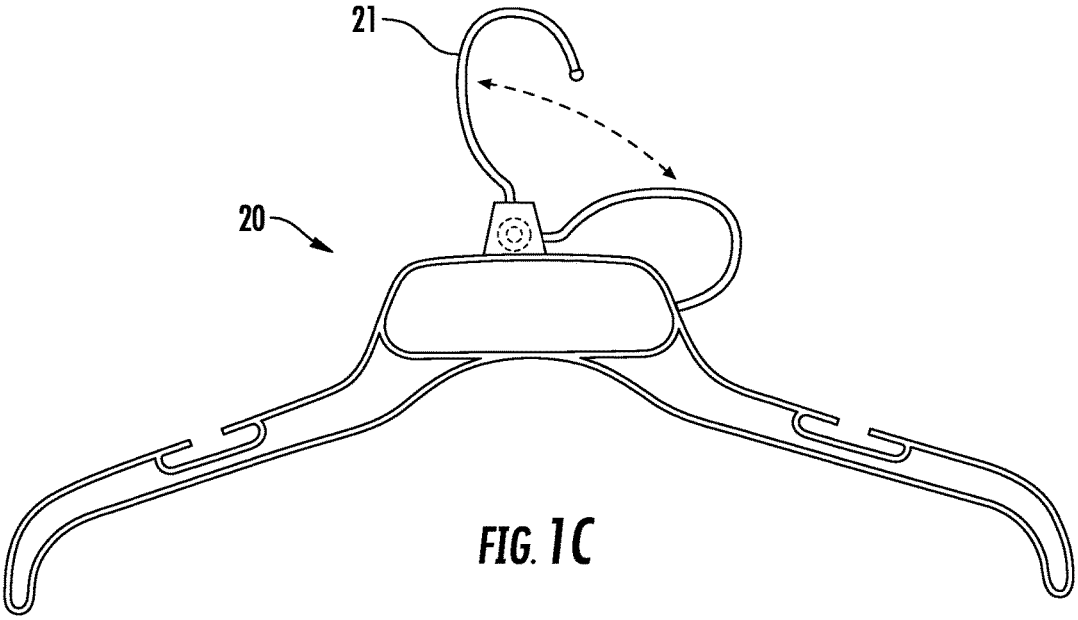
FIG. 1C is a rear plan view of the hanger of FIG. 1B.
Figure 1D:
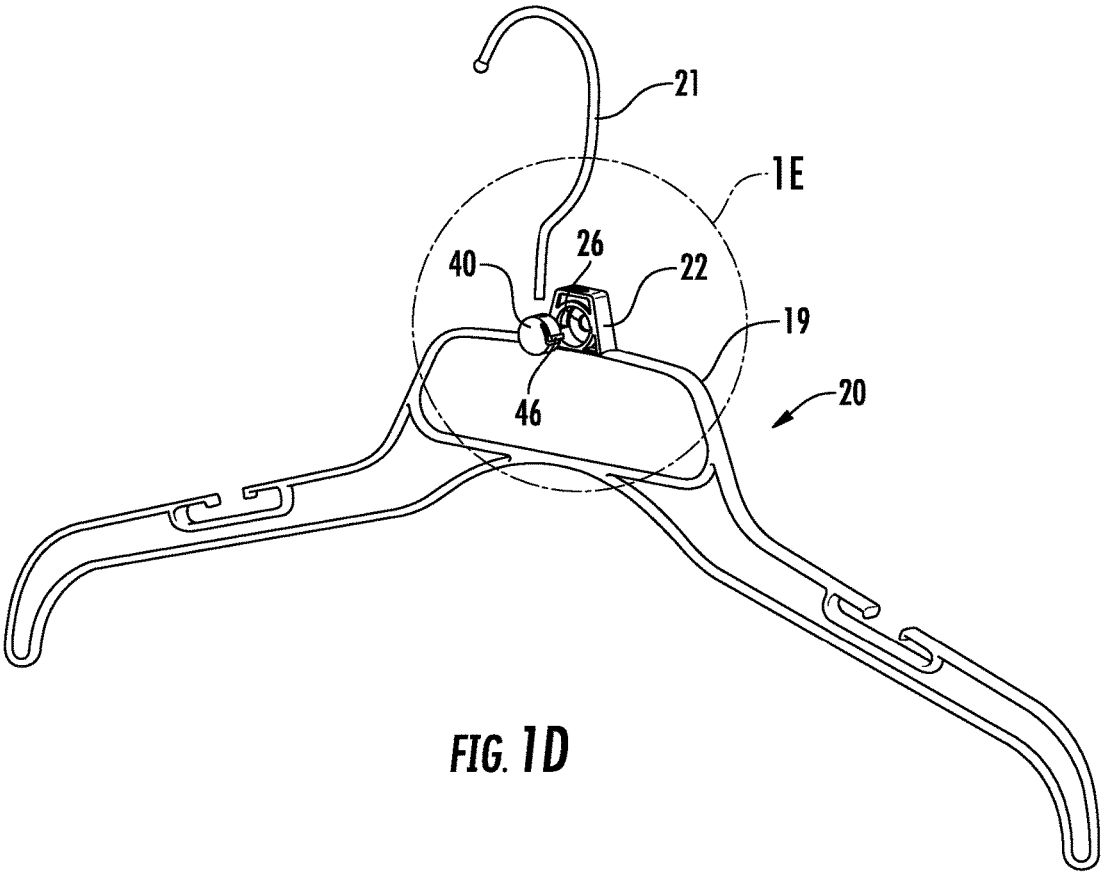
FIG. 1D is a front partially exploded perspective view of the hanger of this invention.
Figure 1E:
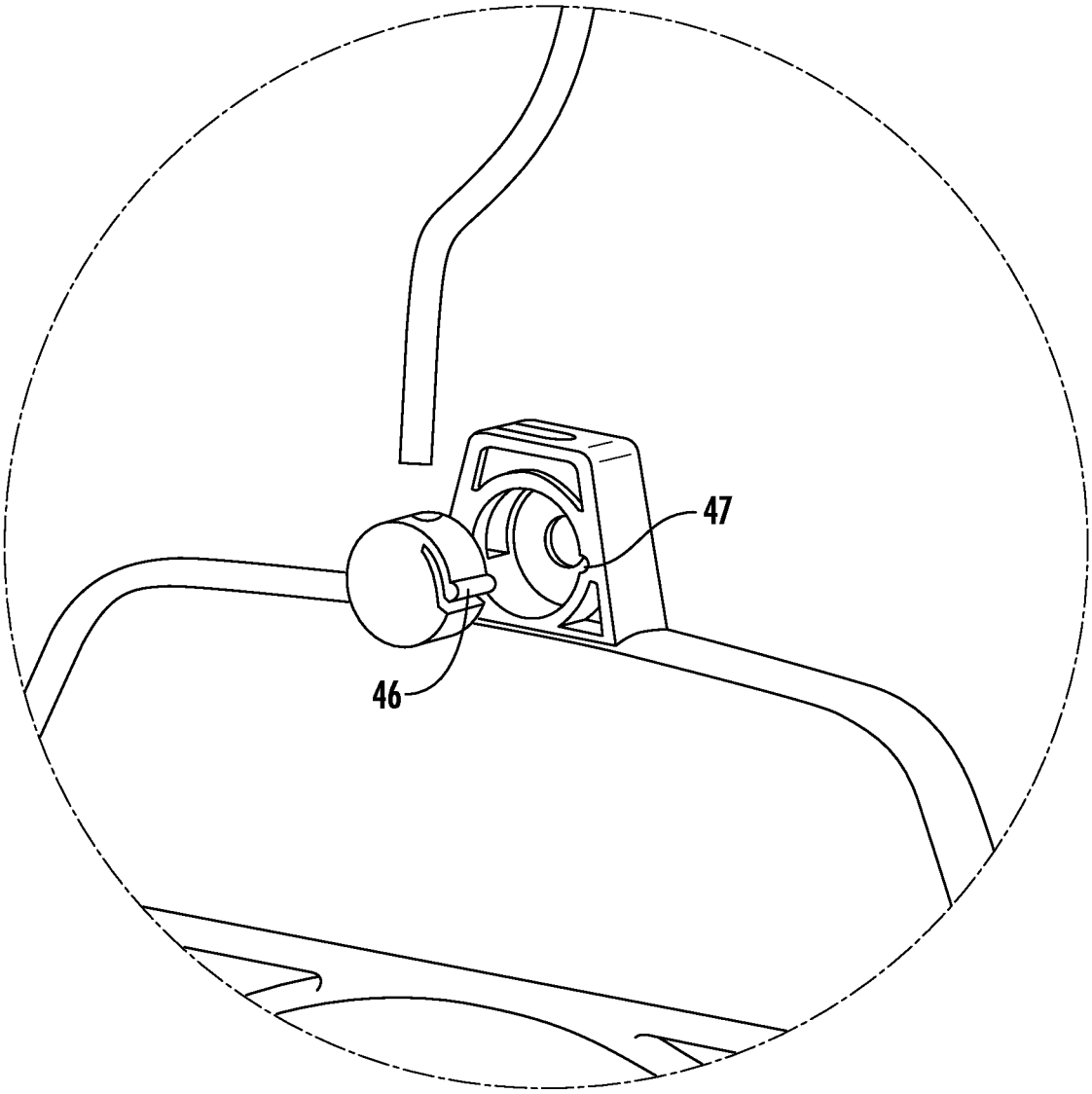
FIG. 1E is an exploded perspective view of the locking means and anchor enabling a vertical lock position for the hook.

FIGS. 1A and 1D are exploded perspective views illustrating overall components and the sequence of assembly. Hook attachment mechanism 40 is pressed into hanger body 20. Hook 21 then gets inserted into hook attachment mechanism 40 which is within hanger mount 22. Size identity tab 60 fits over hook 21 and locks on to an opening for sizer nub 36 (FIG. 2) when required for use.

FIG. 1B is a rear plan view illustrating the assembled version of the hanger showing the hook 21 movable between the horizontal and vertical positions.

FIG. 1C is a front plan view illustrating the assembled version of the hanger showing the movable hook 21.

FIGS. 1A-1C illustrate hook 21 pivoted into the upright (vertical) position, and hanger 20 functions as a conventional garment hanger for supporting and displaying a garment. However during transportation, hook 21 can be folded into the horizontal position to reduce the footprint of the hanger and the overall size of the shipping box into which the garments and or hangers can be packed. The reduction of size of the carton will reflect into reduced dimensional packaging and shipping costs. The hanger of this invention employs a locking mechanism FIG. 5E (positioner lock 46 locking into recess 47 in receptacle 26) to lock the hanger hook to remain upright and locked into the vertical position or easily folded (horizontal) during transportation and shipping. The simplicity of the movement of the hook allows the invention to be cost effective to manufacture, easy to assemble and simple for pivoting in upright or folded positions.

As discussed above, the folded state of the hanger provides a reduced footprint of the hanger creating space savings in packaging and transport. In order to save time and added labor expense at the retail level, the garment is placed on the hanger at the point of garment manufacturing and placed into a shipping box or container. Upon delivery to the retailer location the retailer has to remove the "garment on hanger" from the box or container and hang appropriately in a distribution center for ecommerce shipment or alternative shipment to an individual store. It is also noted that when shipping the hangers, such as from the hanger manufacturer to the garment manufacturer, without garments in full hanger only boxes, the size of the overall box of hangers is reduced further reducing the footprint of the box and the space required in shipping hangers only, reducing box dimension cost.

Figure 2A:
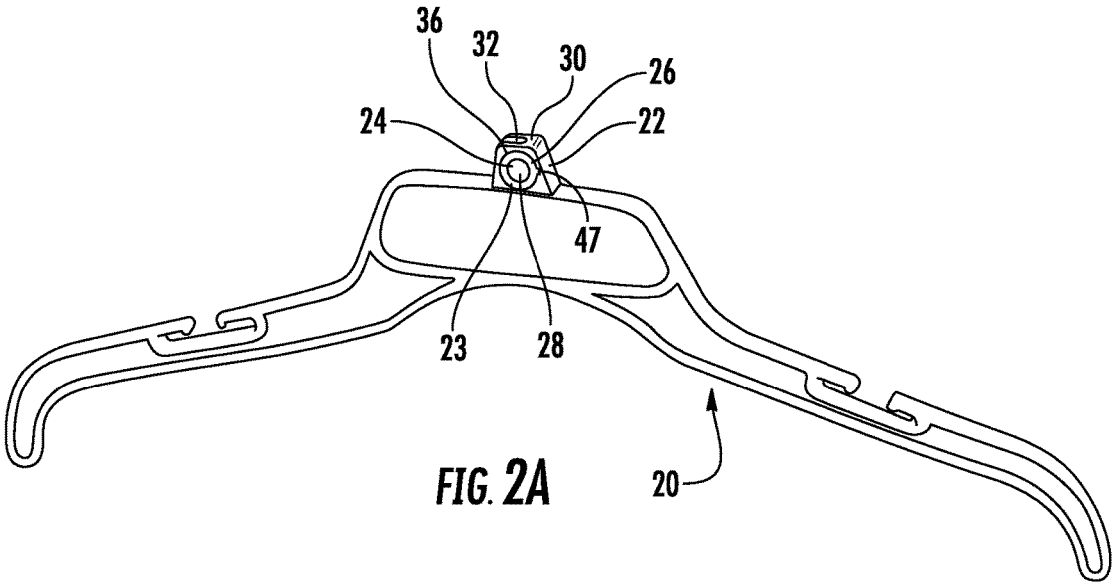
FIG. 2A is a front perspective view of the hanger body showing the mount for the hook attachment.
Figure 2B:
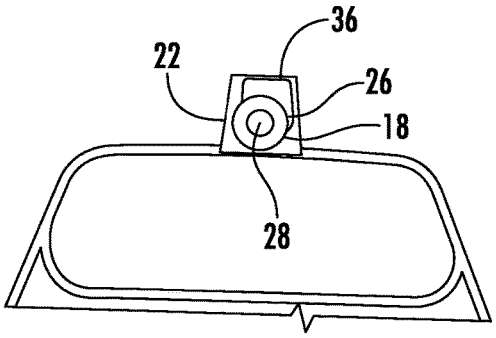
FIG. 2B is an enlarged front view of a portion of the mount for the hook attachment of this invention.
Figure 2C:
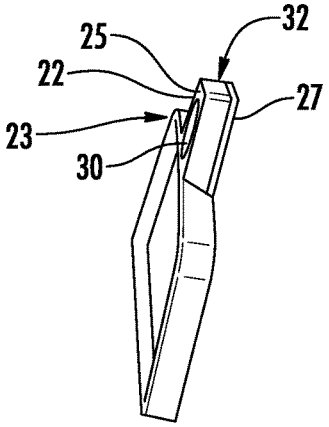
FIG. 2C is a left end view of the upper portion of the mount of the invention shown in FIGS. 2A and 2B.
Figure 3A:
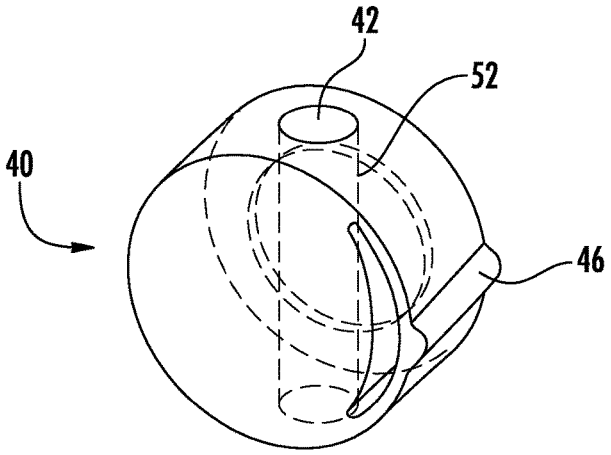
FIG. 3A is a perspective view of the hook attachment.
Figure 5A:
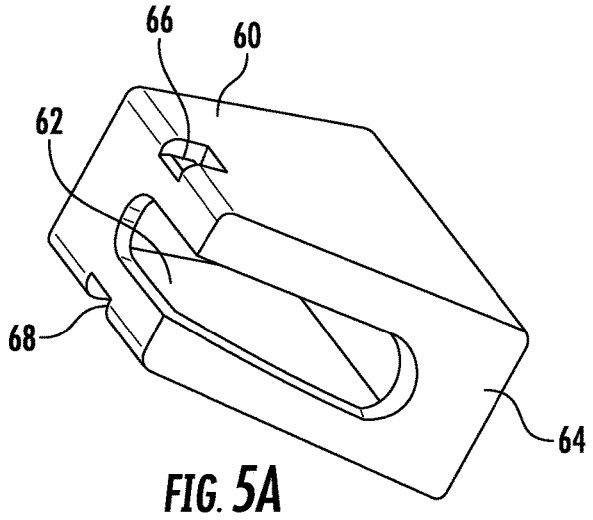
FIG. 5A is a perspective view of a size identity tab for use with the hanger of this invention.
Figure 5B:
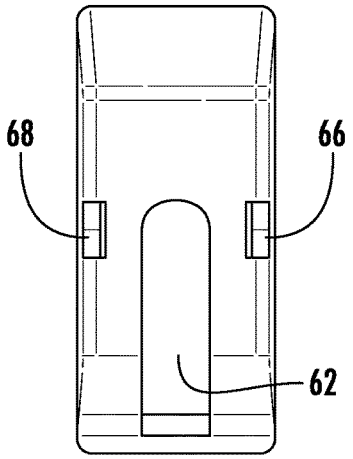
FIG. 5B is a top plan view of the size identity tab of FIG. 5A.
Figure 5C:
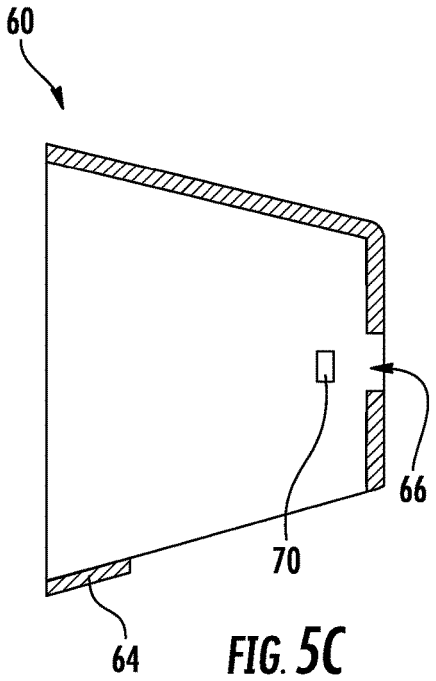
FIG. 5C is a right side sectional view of the size identity tab of FIG. 5A.

FIGS. 2A-2C show the components of molded hanger body 19. FIGS. 2B and 2C are enlarged views for the inner works of this invention. The top portion of hanger body 19 has a mount 22 for hook attachment, which consists of front and back walls 25 and 27. The front wall 25 has a protrusion 24 having a receiver hole 18 and is parallel to the closed back wall 27 having a back closed wall protrusion with boss 30. These two walls define a recess 32 to hold and position the hook in the vertical or horizontal positions. Front wall 25 has an anchor 23 for hook attachment 22 (FIGS. 2A, B, C and D) which fits therein and also includes vertical hook positioner receptacle or recess 26 which receives positioner lock 46 (see FIG. 1D). Closed wall 27 contains back wall boss 28 which provides an additional bearing surface for the carrier of the anchor 23 for hook attachment of hook mechanism 40 (FIGS. 3A, B, C and D). Mount 22 for hook attachment also contains an opening for a sizer locking nub 70 (FIGS. 5C, D, E and F) which allows sizer identity tab 60 as shown in FIG. 1A to lock onto the hanger mount 22.

FIGS. 3A, B, C and D show an embodiment of hook attachment 40. A bevel edge lead-in 48 will fit into the anchor 23 shown in FIG. 2. Boss socket 52 formed within hook attachment 40 stabilizes hook attachment 40 on back wall boss 28 also shown in FIG. 2B. Flexible member 44 is compressed into space 50 to receive position lock 46 located therebehind when hook attachment 40 in anchor 23 for hook attachment 40 is rotated. Positioner lock or nib 46 fits into vertical hook positioner receptacle 26 shown in FIG. 2B, then hook 21 is inserted in hook attachment mechanism 40 in the vertical position. Positioner lock 46 is a nib with void 50 behind the nib to receive flexible member 44 to allow positioner lock 46 to move to capture receptacle 26.

Figure 3B:
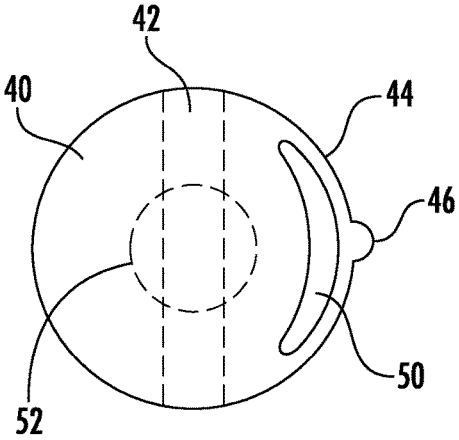
FIG. 3B is a front plan view of the hook attachment of FIG. 3A.
Figure 3C:
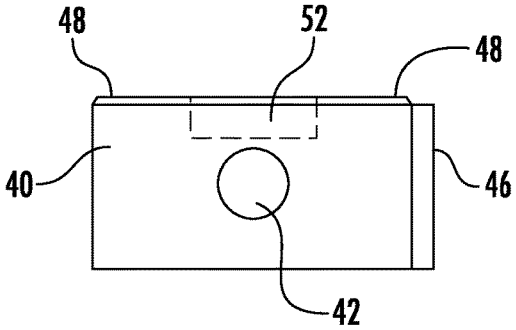
FIG. 3C is a top plan view of the hook attachment of FIG. 3A.
Figure 3D:
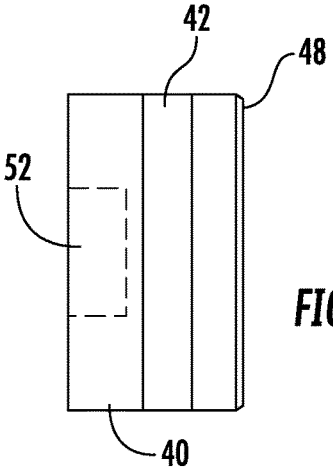
FIG. 3D is a right side plan view of the hook attachment.
Figure 4A:
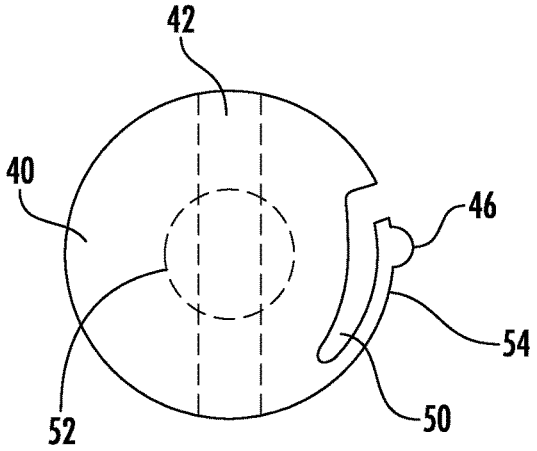
FIG. 4A is a front plan view of an alternative embodiment of a hook attachment.
Figure 4B:
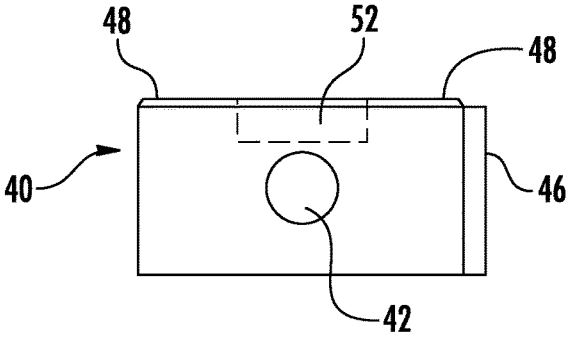
FIG. 4B is a top plan view of the hook attachment of FIG. 4A.
Figure 4C:
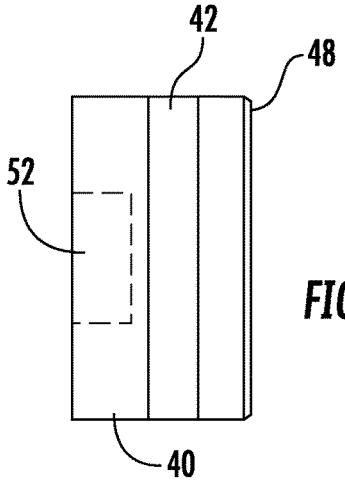
FIG. 4C is a right side plan view of the hook attachment of FIG. 4A.

FIG. 4A shows a second embodiment for the hook attachment 40. This version replaces flexible member 44 as shown in FIG. 3B with a cantilever flexible member 54. When hook attachment mechanism 40 is rotated, cantilever flexible member 54 flexes into the void 50. When using the proper direction of bevel edge lead in 48, this part will be compressed into anchor 23 shown in FIGS. 2A and B. Boss socket 52 stabilizes hook attachment mechanism 40 on back wall boss 28 also shown in FIGS. 2A and B. Positioner lock 46 fits into vertical hook positioner receptacle 26 shown in FIGS. 2A and B, and then hook 21 is inserted in hook attachment 40 in the vertical position.

Figure 5D:
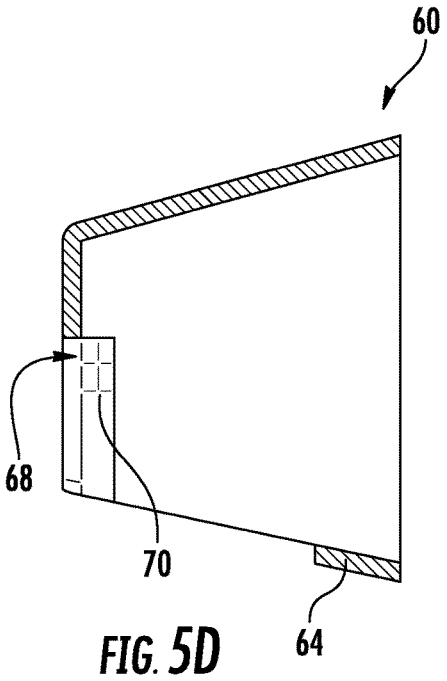
FIG. 5D is a left side sectional view of the size identity tab of FIG. 5A.
Figure 5E:
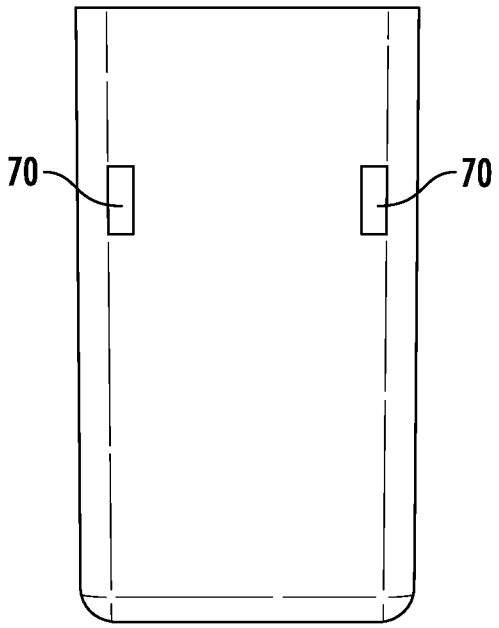
FIG. 5E is a bottom plan view of the size identity tab of FIG. 5A.
Figure 5F:
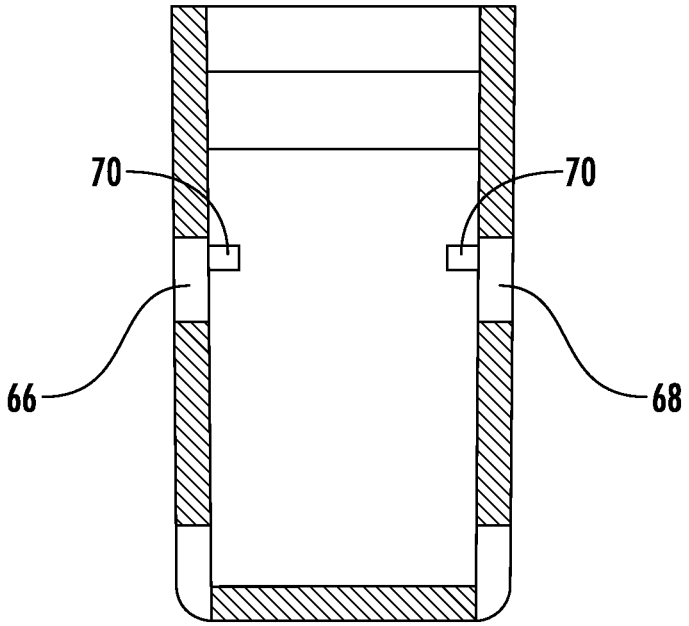
FIG. 5F is a cross-sectional view of the size identity tab of FIG. 5A

FIGS. 5A-F shows an embodiment of size identity tab 60 which is optional for use with the hanger of this invention. Size identity tab 60 can be attached to opening for sizer nub 36 shown in FIGS. 2A and B. Size identity tab 60 is placed over hook 21 via sizer recess 62 and locks onto sizer locking nubs 70 as shown in FIGS. 5D-E. The four sided shape of size identity tab 60, allows hook 21 to substantially pivot vertical to horizontal while the tab is held firmly on the mount 22. The sizer locking nubs 70 allows size identity tab 60 to easily lock into opening for sizer nub 36 but removal is more difficult due to the interference fit between sizer locking nub 70 and opening for sizer nub 36 ensuring that the size tab cannot be unintentionally removed. This allows for the size tab indicator to be attached onto mount 22 prior to garment hanging or shipping, again saving time and cost at the retail level or at a later time. Bridge 64 on size identity tab 60 provides additional structural support for size identity tab 60. The purpose of a size identity tab is to allow for a garment that is hung on the hanger to have the size of that garment displayed from three directions on the hanger when hanging on a display rack. Size identity tab 60 has three flat printable surfaces which can be utilized for imprinting garment size identification.

Hook attachment 40 can only be inserted through front wall hanger protrusion with receiver hole 24. When hook attachment 40 is inserted in the singular proper direction with boss socket 52 facing back wall boss 28, and positioner lock 46 aligns with vertical hook positioner receptacle 26, this will cause the hole 42 to be positioned in the upright vertical position for proper alignment of the hole 42 to accept hook 21 for easy and proper hook insertion. Hook attachment 40 will then line up and mate onto back wall boss 28 on back closed wall protrusion with boss 30 which is used to stabilize hook attachment mechanism 40 on back wall protrusion with boss 30. In a preferred embodiment, the hook can be inserted once hook attachment 40 is inserted into the hanger. It is also noted hook 21 is rotatable 360° when inserted into hook attachment 40.

Hook attachment mechanism 40 rotates in anchor 23 and on back wall boss 28 in a clockwise or counter clockwise direction. Once hook 21 is inserted into hook attachment mechanism 40 this will allow movement of hook attachment mechanism 40 to move only in the direction allowed in the recess to position hook vertical or horizontal 32.

Hook attachment mechanism 40 has a flexible member 44 and positioner lock 46 that when hook 21 is inserted and force is applied to rotate the hook attachment mechanism 40 and moved into recess to position hook vertical or horizontal 32, the tension will cause flex member 44 to collapse into the void to receive flexible member 50 using that space created behind the positioner lock 46 to allow for movement. When hook attachment mechanism 40 is rotated opposite direction positioner lock 46 and flexible member 44 expand to original position reducing tension to allow hook 21 to be back in upright vertical position.

It should also be noted that hook attachment mechanism 40 has hole for hook 42 made purposely off center to account for the space used for the back wall boss 28 and the boss socket 52. This will allow hook 21 to be centered properly for assembly on the plane of hanger body 20 so that it can glide in recess to position hook vertical or horizontal 32.

The cantilever version works in similar manner.

Hook attachment mechanism 40 can rotate in anchor 23 and on the back wall boss 28 and on boss socket 52 in a clockwise or counter clockwise direction. Once hook 21 is inserted into hook attachment 40, this will allow movement of hook mechanism 40 to move only in the direction allowed in the recess to position hook vertical or horizontal 32.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

REFERENCE NUMERALS IN THE DRAWINGS

18 Receiver hole
19 Hanger body
20 Hanger
21 Hook
22 Mount for hook attachment
23 Anchor
24 Front wall hanger protrusion
25 Front wall
26 Vertical hook positioner receptacle
27 Closed back wall
28 Back wall boss
29 Central head
30 Back closed wall protrusion with boss
31 Arms
32 Recess to position hook vertical or horizontal
36 Opening for sizer nub
40 Hook attachment mechanism
42 Hole for hook
44 Flexible member
46 Positioner lock or nib
47 Recess in receptacle 26
48 Bevel edge lead in
50 Void to receive flexible member
52 Boss socket
54 Cantilever flexible member
60 Size Identity tab
62 Sizer recess allowing position of hook movement
64 Bridge
66 Left hole to form locking nub
68 Right hole to form locking nub
70 Sizer locking nubs

The invention claimed is:

1. A garment hanger having a foldable hook to be in a vertical or horizontal position, said hanger comprising:

a hanger body;

said hanger body having a central head and arms formed with said arms to support a garment;

said central head comprising a mount integrally formed with and located on top of said central head;

said mount comprising an anchor to which said hook is attached to said hanger body;

a hook attachment attached to the bottom of said hook and comprising a rotatable cylindrical member;

said rotatable cylindrical member having quadrant locations on top, on the right side, on the bottom and on the left side and a recess extending downwardly from said top of said rotatable cylindrical member to receive and hold said hook;

said hook attachment attached to said anchor to attach said hook attachment to said hanger body;

said anchor comprising front and rear walls in which said rotatable cylindrical member is received;

said front wall having an opening enabling viewing of said rotatable cylindrical member and said rear wall being closed blocking access to said anchor; and wherein said rotatable cylindrical member comprises a locking nib located on its periphery, said locking nib formed on a flexible member biased out from said rotatable cylindrical member said anchor comprises a locking recess into which said locking nib fits to fix the location of said rotatable cylindrical member;

wherein said rotatable cylindrical member comprises an open space behind said flexible member, said flexible member being flexible so as to enable said locking nib to collapse inwardly as said rotatable cylindrical member rotates within said anchor, wherein said locking nib snap fits into said locking recess as said cylindrical member is rotated to fix the vertical position of said hook; and said hook movable from said vertical position causing said locking nib to slide out of said locking recess, forcing said flexible member into said open space freeing said locking nib from said locking recess permitting movement of said hook away from said vertical position.

2. A garment hanger according to claim 1, wherein said flexible member comprises a cantilever member integrally formed with said rotatable cylindrical member.

3. A garment hanger according to claim 1, further comprising a sizer tab formed of opposite closed side walls, front and rear walls and a top wall, a slot formed in said sizer tab and formed in said front and said top wall, said sizer tab having an open bottom to permit said sizer tab to fit onto said mount when said hook is attached to said hanger body with said slot accommodating said hook in whatever position said hook assumes, said side walls comprising side wall locking nubs projecting inwardly from said side walls to lock said sizer tab to said hanger mount.

4. A garment hanger according to claim 3, wherein said side wall locking nubs are movable outwardly from locking into said hanger mount to permit removal of said sizer tab from said hanger.

* * * * *